US005251460A

United States Patent [19]

DeMarco et al.

[11] Patent Number: 5,251,460

[45] Date of Patent: Oct. 12, 1993

[54] COOLER COVER FOR BEVERAGE KEGS

[76] Inventors: Edward DeMarco, 2233 Browning Rd., Apt. 2, Pennsauken, N.J. 08110; John M. Friel, 112 W. Central Ave., Apt. 2, Moorestown, N.J. 08057

[21] Appl. No.: 966,516

[22] Filed: Oct. 26, 1992

[51] Int. Cl.[5] ..... E25D 3/08

[52] U.S. Cl. ..... 62/371; 62/457.1; 62/400; 220/903

[58] Field of Search ..... 62/457.1, 457.4, 371, 62/372, 400, 389; 220/DIG. 1, 903

[56] References Cited

U.S. PATENT DOCUMENTS

| | | | |
|---|---|---|---|
| 81,814 | 9/1868 | Nuellens et al. | 62/400 |
| D. 273,833 | 5/1984 | Taylor et al. | D7/77 |
| 1,664,702 | 4/1928 | Osborn | 62/371 |
| 1,999,670 | 4/1935 | Strouse et al. | 62/372 |
| 3,443,397 | 5/1969 | Donovan et al. | 62/457.1 |
| 4,483,157 | 11/1984 | Human | 62/400 |
| 4,531,381 | 7/1985 | Toro et al. | 62/457.4 |
| 4,653,290 | 3/1987 | Byrne | 62/372 |
| 4,802,344 | 2/1989 | Livingston et al. | 62/372 |
| 4,835,985 | 6/1989 | Ilvento | 62/372 |

*Primary Examiner*—Albert J. Makay
*Assistant Examiner*—William C. Doerrler
*Attorney, Agent, or Firm*—Thomas A. Lennox

[57] ABSTRACT

A beer keg cover constructed of wet or dry fabric and foam composite materials for scuba divers includes a top lid with an elastic edged opening to snap fit over the dispensing pipe of the keg, a circular zipper closure with a hinge attachment for the lid with a vertical slip opening closed by a zipper to open the cylindrical covering. The cover also includes openings aligned with the standard hand grips opening through the top vertical flange of the keg with sealing flaps to reduce heat transfer.

11 Claims, 2 Drawing Sheets

COOLER COVER FOR BEVERAGE KEGS

BACKGROUND OF THE INVENTION

This invention relates to insulated covers for beverage kegs. More specifically, this invention relates to an insulated cover to keep beer kegs cold while being stored out of a refrigerator, while being transported and while the contents are dispensed.

Beverage kegs, in particular, beer kegs, are a popular means for dispensing carbonated beverages at parties, picnics and the like. It is important to keep the keg cold and that has posed problems, particularly when there is an extended period of time from the refrigerator storage to the time of the party. It has been common to store the keg in insulating blankets with dry ice or even regular ice, although the water generated is difficult to handle, particularly in a motor vehicle. Various outer cooling storage shells have been provided, but they are not handy and form an extremely heavy combination that is not convenient. Further, such devices do not readily fit in automobile trunks.

A difficulty with providing an insulated cover for beer kegs is that it makes the combination extremely difficult to lift and handle. The disclosure in U.S. Pat. No. 4,802,344 to Livingston et al addresses that problem with external straps attached to handles to bear the very substantial weight of the full keg. Unfortunately, that type of handle is clumsy and not easy to use, particularly by one person. Further, the Livingston et al device utilizes a slit across the cover which is open and allows substantial heat transfer to the keg. Further, the cylindrical cup shape of the cover makes it difficult to place the keg in the device and does not easily allow for a tight fit of the cover over the keg.

This invention is directed to use with beverage kegs that have a vertical dispensing pipe extending upwardly from the top of the keg. The dispensing valve is attached to that pipe for dispensing the beverage. This invention is also directed for use with kegs with hand holds and lifting openings opening through an upper rim through which the fingers are inserted and the keg lifted against a horizontal surfaces formed on both sides of the keg.

None of the prior art devices satisfy the needs described above, nor do they attain the objects of the present invention described hereinbelow.

SUMMARY

It is an object of the present invention to provide a beverage keg cooler device that allows easy storage and retards warming of the keg outside of the refrigerator.

It is a further object of the present invention to provide a keg cover which allows the covered keg to be lifted and moved in exactly the same fashion and with the same movements that are used without the cover being present.

It is an additional object of the present invention to provide a keg cover which allows easy placement of the keg within the cover while allowing a relatively tight fit of the cover over the keg.

It is a further object of the present invention to provide a keg cover which may be used either wet or dry, with or without ice on the inside or outside of the cover.

It is an additional object of the present invention to provide a keg cover which provides an effective seal around the dispensing pipe and does not in any way interfere with the dispensing of the beverage from the keg.

Further, it is an object of the invention to provide a keg cover which virtually eliminates the possibility of beverage being spilled into the inside of the keg cover allowing for easier clean up and re-use.

An aspect of the invention is a thermally insulated portable cover device for storing and carrying a beverage keg. The keg has a dispensing pipe extending upwardly and centrally from the top of the keg and has hand gripping openings into opposite upper sides of the generally cylindrical side wall. The openings form horizontal depending surfaces that can receive a person's hands to allow the keg to be relatively easily lifted. The cover device includes an open topped insulated hollow cylindrical flexible cover member that includes a cylindrical side wall portion having an upper circular edge and a circular bottom wall portion. The cover defines an internal cavity into which the beverage keg coaxially fits. The cover device further includes a thermally insulated closing lid that includes a circular shaped disc member having a circular shaped peripheral edge coterminous with the upper circular edge of the cylindrical side wall portion, fastening means to releasably fasten the peripheral edge of the disc shaped member to the upper circular edge of the cylindrical side wall portion, and a centered round hole forming a circular shaped edge around the hole. The circular shaped edge includes resilient material allowing it to stretch to a greater diameter opening, and is sized to be smaller in diameter than an outside diameter of the dispensing pipe extending upwardly from the top of the beverage keg when it is coaxially fitted inside the cover device. The cover device also includes vertical fastening means to releasably fasten vertical edges of a vertical cut through the cylindrical side wall portion extending from a position on upper circular edge downwardly to a lower position on the side wall portion. The cover device further includes a pair of openings through opposite sides of the cylindrical side wall portion at a height to correspond and align with and to open directly to the horizontal surfaces of the gripping handle openings into the beverages upper rim of the keg coaxially fitted inside the cover device. The cover device also includes cover means to selectively insulate and cover the pair of openings through the cylindrical side wall portion of the cover device.

It is preferred that the insulated hollow cylindrical flexible cover member and the disc member of the closing lid be constructed of a resilient material of two woven fabrics sandwiching a resilient polymeric foam sheet. It is further preferred that the closing lid further include a patch of resilient material attached centrally to the circular shaped disc shaped member and the centered round hole opens through the patch of resilient material. It is more preferred that the circular shaped disc member and the patch be both of resilient material and the centered round hole opens commonly through the center of circular shaped disc member and the patch. It is also preferred that the centered round hole have a diameter of about two and one half inches. It is further preferred that the fastening means to releasably fasten the peripheral edge of the disc shaped member to the upper circular edge of the cylindrical side wall portion be a zipper mechanism. It is also preferred that the vertical cut through the cylindrical side wall portion extend from a position on upper circular edge downwardly to a position on the side wall portion proximate the bottom wall portion. It is further preferred that the vertical fastening means to releasably fasten vertical edges of the vertical fastening means to releasably fasten vertical edges of the vertical cut be a zipper mechanism. It is also preferred that the cover means include a pair of insulated fabric flaps hingeably attached on the cylindrical side wall above the openings releasably held over the openings by fabric hook and loop fasteners attached on opposing surfaces of an underside of the flaps and an outside surface of the cylindrical side wall. It is also preferred that the cover device further include hinge attachment means to hingeably attach the thermally insulated closing lid to the hollow cylindrical flexible cover member.

Another aspect of the invention is a method for storing and carrying a beverage keg having a dispensing pipe extending upwardly centrally from a top of the keg and having hand gripping openings into opposite sides of a flange extending upwardly from the upper edge of a cylindrical side wall of the keg. Again the openings form horizontal depending surfaces that can receive a person's hands to allow the keg to be lifted. The method includes providing a thermally insulated portable cover device as described above. The method further includes coaxially fitting the beverage keg into internal cavity of the cylindrical flexible cover, while aligning the hand gripping depressions of the beverage keg under the pair of openings through the cylindrical side wall portion. The method also includes fastening the vertical edges of the vertical cut together using the vertical fastening means, and pulling the circular shaped disc member downwardly stretching the centered round hole over the vertical dispensing pipe. The method further includes fastening the peripheral edge of the circular shaped disc member to the upper circular edge of the cylindrical side wall portion to enclose the keg. The method then includes extending fingers of hands of a person into the openings through the cylindrical side wall portion to engage the horizontal surfaces of the gripping handle openings in the beverage keg, and lifting on the horizontal surfaces to lift the beverage keg and cover device combination.

DESCRIPTION OF PREFERRED EMBODIMENTS

Figure 1:
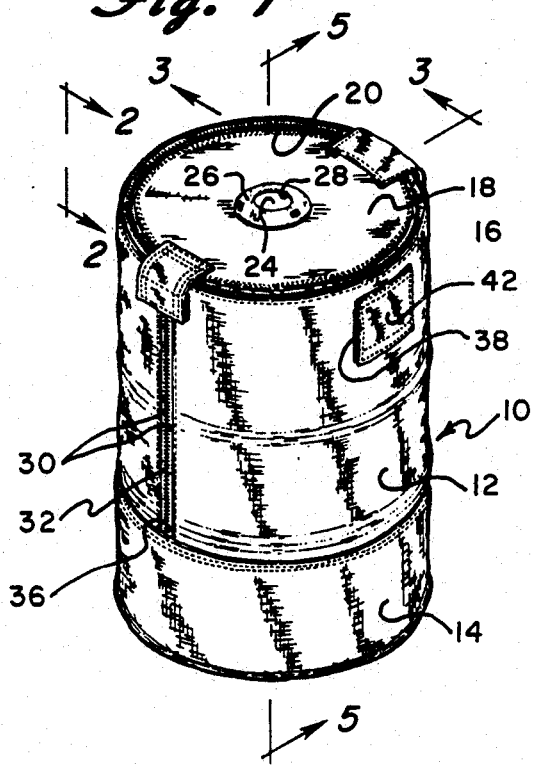
FIG. 1 is a perspective view of a beverage keg cover of the present invention.
Figure 2:
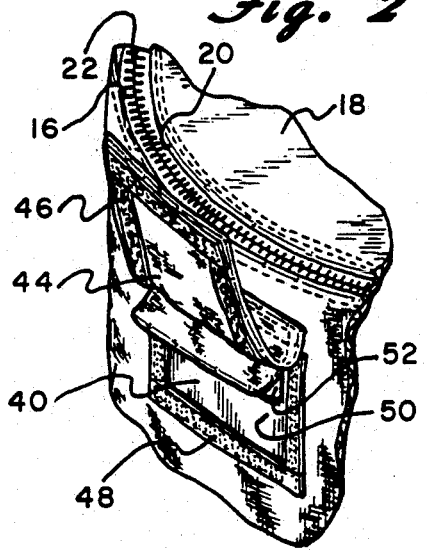
FIG. 2 is an enlarged perspective view of a section of the cover with the cover flap raised to expose a hand hold of a keg in the cover device shown in FIG. 1.
Figure 3:
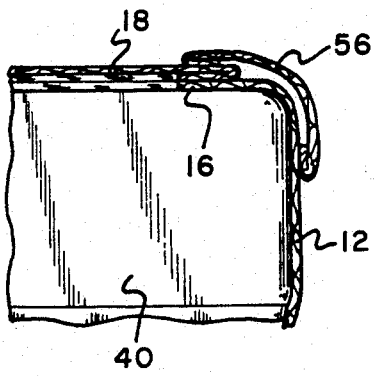
FIG. 3 is a partial cross-sectional view taken along lines 3—3 of FIG. 1.
Figure 4:
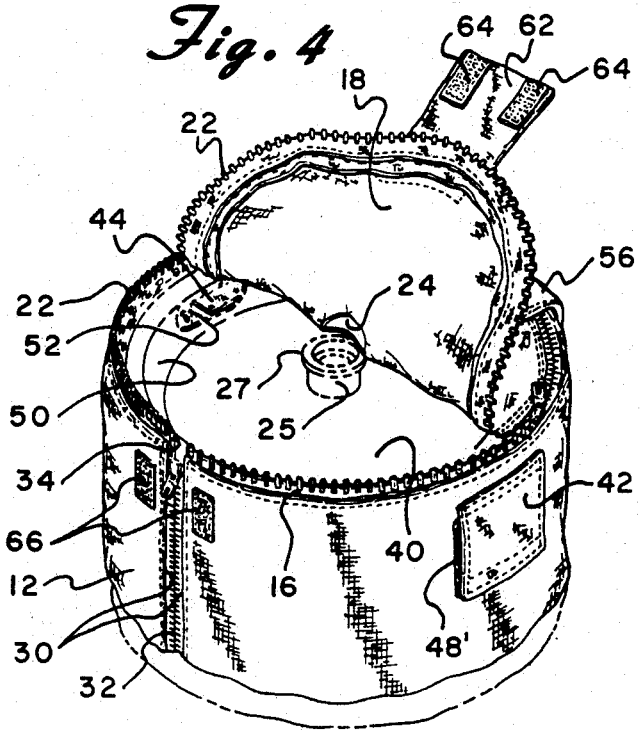
FIG. 4 is a partial perspective view of the keg cover illustrated in FIG. 1 with the top closing lid partially zipped off exposing the keg stored inside.
Figure 5:
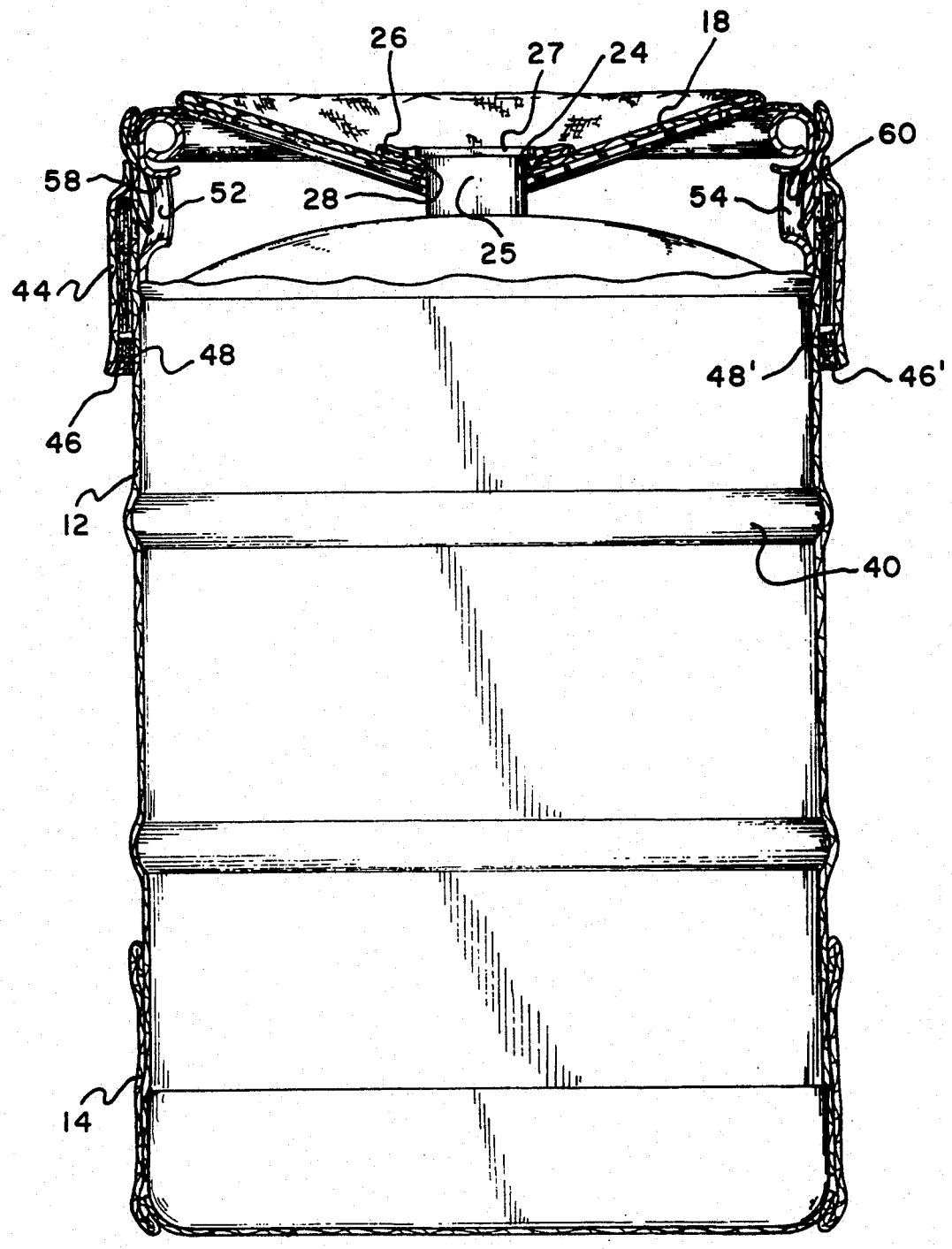
FIG. 5 is a cross-sectional view taken along line 5—5 with the beverage keg added to the interior and the top lid pulled down over the dispensing pipe essentially heat sealing the top.

Cover device 10 is illustrated in FIG. 1 constructed of a fabric composite material with woven stretchable nylon fabric outer and inner layers and resilient polyurethane foam interior sandwiched between the two fabric layers. The composite material is similar to that used in either wet suits or dry suits for scuba divers which is essentially elastic in nature and conforms to the outside surface of beverage keg 40. Most importantly, elastic or at least resilient material is used in reinforcement panel 26 around hole opening 24 defining circular edge 28 of the hole. The elastic nature of the structure allows hole 24 to be pulled downwardly over flange lip 27 of dispensing pipe 25 of keg 40 as illustrated in FIGS. 4 and 5. Cover device 10 includes cylindrical cover member 12 joining bottom cup section 14 which may have minimal sidewall height or be a substantial height as illustrated in this embodiment. Bottom section 14 may utilize additional reinforcement and a non-porous outer surface such as plasticized polyvinyl chloride film. Cylindrical cover member 12 terminates at upper circular edge 16 that is joined through circular zipper 22 with peripheral circular edge 20 of disc lid 18. In addition to allowing lid 18 to be hingeably lifted off connected through hinge strap 56 shown in FIG. 3 cylindrical cover member 18 is openable through a vertical slit opening and extending from upper point 34 on upper peripheral edge 16 downwardly to lower point 36 proximate bottom section 14. Edges 30 of the vertical slit opening are connected through vertical zipper 32 extending the full length and closing cylindrical cover around keg 40. Flap covers 42 and 44, the later shown in FIGS. 2 and 5 may be lifted upwardly when the combination of keg 40 and cover device 10 is to be lifted. When stored flaps 42 and 44 are pulled downwardly and connected through Velcro® strip attachments such as loop Velcro® strips 46 on the underside of flap 44 and hook Velcro® strips 48 on the outside of cover section 12. Flap 44 selectively covers and opens opening 50 through cover member 12 to expose hand grip opening 52 in keg 40. Likewise, opening 38 through cover section 12 is covered with flap 42 to either cover or expose keg opening 54. The keg openings 52 and 54 provide access to horizontal surfaces 58 and 60 respectively to receive the hands to allow keg 40 to be lifted. With flaps 42 an 52 open, these hand holes can be used in their regular fashion. As shown in FIGS. 4 and 5, flap 42 covers and uncovers hand hold opening 54 through the upper rim of keg 40 allowing the hand to reach in and lift on surface 60. Flap 42 is held in place by Velcro® strips 46' and 48', essentially identically to that with strips 46 and 48. In FIG. 5, lid 18 has been pulled downwardly to stretch hole 24 bounded by circular edge 28 over flange 27 of dispensing pipe 25. In this position, the standard pouring mechanisms may be engaged onto dispensing pipe 25 to pour and maintain the pressure of the beverage inside of keg 40. Flap 62 attached to lid 18 is attached through Velcro® strips 64 to Velcro® strips 66 positioned on the opposite sides of zipper 32 on the outside surface of cylindrical cover member 12 to reduce any heat transfer to the keg through any space close to the top of the zipper.

While this invention has been described with reference to the specific embodiments disclosed herein, it is not confined to the details set forth and the patent is intended to include modifications and changes which may come within and extend from the following claims.

We claim:

1. A thermally insulated portable cover device for storing and carrying a beverage keg having a dispensing pipe extending upwardly centrally from a top of the keg and having hand gripping depressions into opposite sides of a rim extending upwardly from an upper edge of a cylindrical side wall of the keg, the depressions forming horizontal depending surfaces that can receive a person's hands to allow the keg to be lifted, the cover device comprising:

(A) an open topped insulated hollow cylindrical flexible cover member comprising a cylindrical side wall portion having an upper circular edge and a circular bottom wall portion, the cover defining an internal cavity into which the beverage keg coaxially fits.

(B) a thermally insulated closing lid comprising:

(i) a circular shaped disc member having a circular shaped peripheral edge coterminous with the upper circular edge of the cylindrical side wall portion, (ii) fastening means to releasably fasten the peripheral edge of the disc shaped member to the upper circular edge of the cylindrical side wall portion, and (iii) a centered round hole forming a circular shaped edge around the hole wherein the circular shaped edge comprises:

(a) resilient material allowing it to stretch to a greater diameter opening, and (a) is sized to be smaller in diameter than an outside diameter of the dispensing pipe extending upwardly from the top of the beverage keg coaxially fitted inside the cover device.

(C) vertical fastening means to releasably fasten vertical edges of a vertical cut through the cylindrical side wall portion extending from a position on upper circular edge downwardly to a lower position on the side wall portion, (D) a pair of openings through opposite sides of the cylindrical side wall portion at a height to correspond and align with to open directly to the horizontal surfaces of the gripping handle openings into the beverage keg coaxially fitted inside the cover device, and (E) cover means to selectively open or cover and insulate the pair of openings through the cylindrical side wall portion of the cover device.

2. The cover device of claim 1 wherein the insulated hollow cylindrical flexible cover member and the disc member of the closing lid are constructed of a resilient material of two woven fabrics sandwiching a resilient polymeric foam sheet.

3. The cover device of claim 1 wherein the closing lid further comprises a patch of resilient material attached centrally to the circular shaped disc shaped member and the centered round hole opens through the patch of resilient material.

4. The cover device of claim 3 wherein the circular shaped disc member and the patch are both resilient material and the centered round hole opens commonly through the center of circular shaped disc member and the patch.

5. The cover device of claim 1 wherein the centered round hole has a diameter of about two and one half inches.

6. The cover device of claim 1 wherein the fastening means to releasably fasten the peripheral edge of the disc shaped member to the upper circular edge of the cylindrical side wall portion is a zipper mechanism.

7. The cover device of claim 1 wherein the vertical cut through the cylindrical side wall portion extends from a position on upper circular edge downwardly to a position on the side wall portion proximate the bottom wall portion.

8. The cover device of claim 1 wherein the vertical fastening means to releasably fasten vertical edges of the vertical cut is a zipper mechanism.

9. The cover device of claim 1 wherein the cover means comprises a pair of insulated fabric flaps hingeably attached on the cylindrical side wall above the openings releasably held over the openings by fabric hook and loop fasteners attached on opposing surfaces of an underside of the flaps and an outside surface of the cylindrical side wall.

10. The cover device of claim 1 further comprising hinge attachment means to hingeably attach the thermally insulated closing lid to the hollow cylindrical flexible cover member.

11. A method for storing and carrying a beverage keg having a dispensing pipe extending upwardly centrally from a top of the keg and having hand gripping openings through opposite sides of a rim extending upwardly from an upper edge of a cylindrical side wall of the keg, the openings forming horizontal depending surfaces that can receive a person's hands to allow the keg to be lifted, the method comprising:

(A) providing a thermally insulated portable cover device comprising:

(I) an open topped insulated hollow cylindrical flexible cover member comprising a cylindrical side wall portion having an upper circular edge and a circular bottom wall portion, the cover defining an internal cavity into which the beverage keg coaxially fits, (II) a thermally insulated closing lid comprising:

(a) a circular shaped disc member having a circular shaped peripheral edge coterminous with the upper circular edge of the cylindrical side wall portion, (b) fastening means to releasably fasten the peripheral edge of the disc shaped member to the upper circular edge of the cylindrical side wall portion, and (c) a centered round hole through the circular shaped disc member forming a circular shaped edge around the hole wherein the circular shaped edge comprises:

(i) resilient material allowing it to stretch to a greater diameter opening, and (ii) is sized to be smaller in diameter than an outside diameter of the dispensing pipe extending upwardly from the top of the beverage keg coaxially fitted inside the cover device, (III) vertical fastening means to releasably fasten vertical edges of a vertical cut through the cylindrical side wall portion extending from a position on upper circular edge downwardly to a lower position on the side wall portion, (IV) a pair of openings through opposite sides of the cylindrical side wall portion at a height to correspond and align with to open directly to the horizontal surfaces of the gripping handle openings into the beverage keg coaxially fitted inside the cover device, and (V) cover means to selectively open or cover and insulate the pair of openings through the cylindrical side wall portion of the cover device.

(B) coaxially fitting the beverage keg into internal cavity of the cylindrical flexible cover, (C) aligning the hand gripping openings of the beverage keg under the pair of openings through the cylindrical side wall portion, (D) fastening the vertical edges of the vertical cut together using the vertical fastening means, (E) pulling the circular shaped disc member downwardly stretching the centered round hole over the vertical dispensing pipe, (F) fastening the peripheral edge of the circular shaped disc member to the upper circular edge of the cylindrical side wall portion, (G) extending fingers of hands of a person into the openings through the cylindrical side wall portion to engage the horizontal surfaces of the gripping handle openings into the beverage keg, and (H) lifting on the horizontal surfaces to lift the beverage keg and cover device combination.

* * * * *